US006817514B2

(12) United States Patent
Kanter et al.

(10) Patent No.: US 6,817,514 B2
(45) Date of Patent: Nov. 16, 2004

(54) CONTAINER HAVING CORNER SUPPORT

(75) Inventors: Allen L. Kanter, Malvern, PA (US); Andrew Sypawka, Doylestown, PA (US); Peter S. Jaffe, Philadelphia, PA (US); Bradley D. Snyder, Allentown, PA (US)

(73) Assignee: Innovation Packaging Designs L.P., Montgomeryville, PA (US)

( * ) Notice: Subject to any disclaimer, the term of this patent is extended or adjusted under 35 U.S.C. 154(b) by 144 days.

(21) Appl. No.: 10/313,890

(22) Filed: Dec. 6, 2002

(65) Prior Publication Data

US 2003/0132277 A1 Jul. 17, 2003

Related U.S. Application Data

(63) Continuation-in-part of application No. 09/969,505, filed on Oct. 2, 2001, now abandoned, which is a continuation of application No. 09/690,059, filed on Oct. 16, 2000, now Pat. No. 6,325,282, which is a continuation of application No. 09/452,560, filed on Dec. 1, 1999, now Pat. No. 6,158,653

(60) Provisional application No. 60/358,758, filed on Feb. 22, 2002, and provisional application No. 60/119,392, filed on Feb. 10, 1999.

(51) Int. Cl.[7] ..... B65D 5/56

(52) U.S. Cl. ..... 229/185.1; 229/120.11; 229/918

(58) Field of Search ..... 229/120.11, 120.18, 229/185.1, 191, 915, 918, 919; 206/509

(56) References Cited

U.S. PATENT DOCUMENTS

| | | | | |
|---|---|---|---|---|
| 2,572,387 | A | 10/1951 | Rayburn | 229/185.1 |
| 3,162,351 | A | 12/1964 | Rudofski | 229/918 |
| 3,667,666 | A | 6/1972 | Pryor | 229/185.1 |
| 4,056,223 | A | 11/1977 | Williams | 229/918 |
| 5,125,568 | A | 6/1992 | Bauer | 229/172 |
| 5,413,276 | A | 5/1995 | Sheffer | 229/120.11 |
| 5,524,815 | A | 6/1996 | Sheffer | 229/120.18 |
| 5,826,728 | A | 10/1998 | Sheffer | 206/774 |
| 5,839,650 | A | 11/1998 | Sheffer | 229/120.11 |
| 5,996,885 | A | 12/1999 | Chu | 229/179 |
| 6,158,653 | A | 12/2000 | Kanter et al. | 229/185.1 |
| 6,325,282 | B1 | 12/2001 | Kanter et al. | 229/185.1 |

*Primary Examiner*—Gary E. Elkins
(74) *Attorney, Agent, or Firm*—Synnestvedt & Lechner LLP

(57) ABSTRACT

A container having an internal corner support for increasing the stacking strength of the container. The container has multiple wall panels. The internal corner support includes first and second panel sections attached pivotally to one another and which are adjacent a corner of the container for providing additional stacking support.

23 Claims, 15 Drawing Sheets

CONTAINER HAVING CORNER SUPPORT

CROSS-REFERENCE TO RELATED APPLICATION

This application claims the benefit U.S. Provisional Application No. 60/358,758 filed Feb. 22, 2002 and is a continuation-in-part of U.S. application Ser. No. 09/969,505 filed Oct. 02, 2001 now abandoned, which is a continuation of U.S. application Ser. No. 09/690,059, filed Oct. 16, 2000 and which issued as U.S. Pat. No. 6,325,282, which is a continuation of U.S. application Ser. No. 09/452,560, filed Dec. 1, 1999, which issued as U.S. Pat. No. 6,158,653, and which claims the benefit of U.S. Provisional Application No. 60/119,392 filed Feb. 10, 1999. Each of the above patents and patent applications is hereby incorporated by reference.

BACKGROUND OF THE INVENTION

1. Field of the Invention

The present invention pertains to containers and boxes used for packaging, shipping, and displaying goods. More particularly, the invention relates to display containers having means to facilitate the stacking of such containers on top of one another.

2. Description of the Related Art

Display containers are widely used for shipping and marketing products. Such containers are especially popular in warehouse-type marketing settings and supermarkets where many containers are opened to display the food or merchandise within and stacked one on top of another. Examples include containers of packaged candy which may be decorated for display purposes. The containers of candy are shipped to the store in stacked form. Store personnel remove any display panels to allow the candy within to be seen and removed, and the containers are then stacked one on top of another on the retail floor.

A major problem with previously known display containers is their lack of strength for stacking. All too often loaded and stacked containers collapse under the weight or become misshaped. Another problem with stacked containers is that one container may partially fall, or "nest" into the container below. This impairs the aesthetic appearance of the display sought by the seller and damages the products within.

Methods of producing stronger containers are known. For example, double walled corrugated containers are stronger than single walled corrugated containers. This added strength, however, does little to prevent nesting.

Accordingly, one object of the present invention is to provide a container with a corner support that opens more reliably.

Another object is to provide a stronger container that is economical to produce.

A further object of the present invention is to provide a stronger container that is easy to assemble and use.

Another object is to provide a container that can be safely stacked during shipping and display.

A still further object is to provide a stronger stackable container that is assembleable from a knockdown state.

Additional objects, advantages and novel features of the invention will be set forth in part in the description which follows, and in part will become apparent to those skilled in the art upon examination of the following, or may be learned from making and using the invention. The objects and advantages of the invention may be realized and attained by means of the combinations pointed out in the appended claims.

SUMMARY OF THE INVENTION

The objects and advantages of the present invention are obtained by providing a container having a corner support. The container includes first, second, third and fourth wall panels which have an inner face and a top end. The first and second wall panels are attached to one another at a first corner, the second and third wall panels are attached to one another at a second corner, the third and fourth wall panels are attached to one another at a third corner, and the first and fourth wall panels are attached to one another at a fourth corner. A glue panel is attached to the inner face of the first wall panel, and a second glue panel is attached to the inner face of the second wall panel. The corner support includes first and second panel sections adjacent the first corner for increasing the stacking strength. The first panel section has a first edge attached pivotally and integrally to the glue panel and has a second edge opposite the first edge. The second panel section has a first edge pivotally attached to the second glue panel and a second edge opposite the first edge which is attached pivotally and integrally to the second edge of the first panel section. This provides an additional support in the corner of the container, preferably spaced from the corner of the container, to provide additional support for containers stacked on top.

The first and second panel sections can be configured for use with a container that has a knockdown state. Here the first and second panel sections move automatically into their desired positions upon assembly of the knockdown into the final container form.

BRIEF DESCRIPTION OF THE DRAWINGS

The foregoing summary and the following detailed description may be better understood when read in conjunction with the accompanying drawings. Various embodiments are shown for the purpose of illustrating the invention. It is understood, however, that this invention is not limited to the precise arrangements shown.

DETAILED DESCRIPTION

Figure 1:
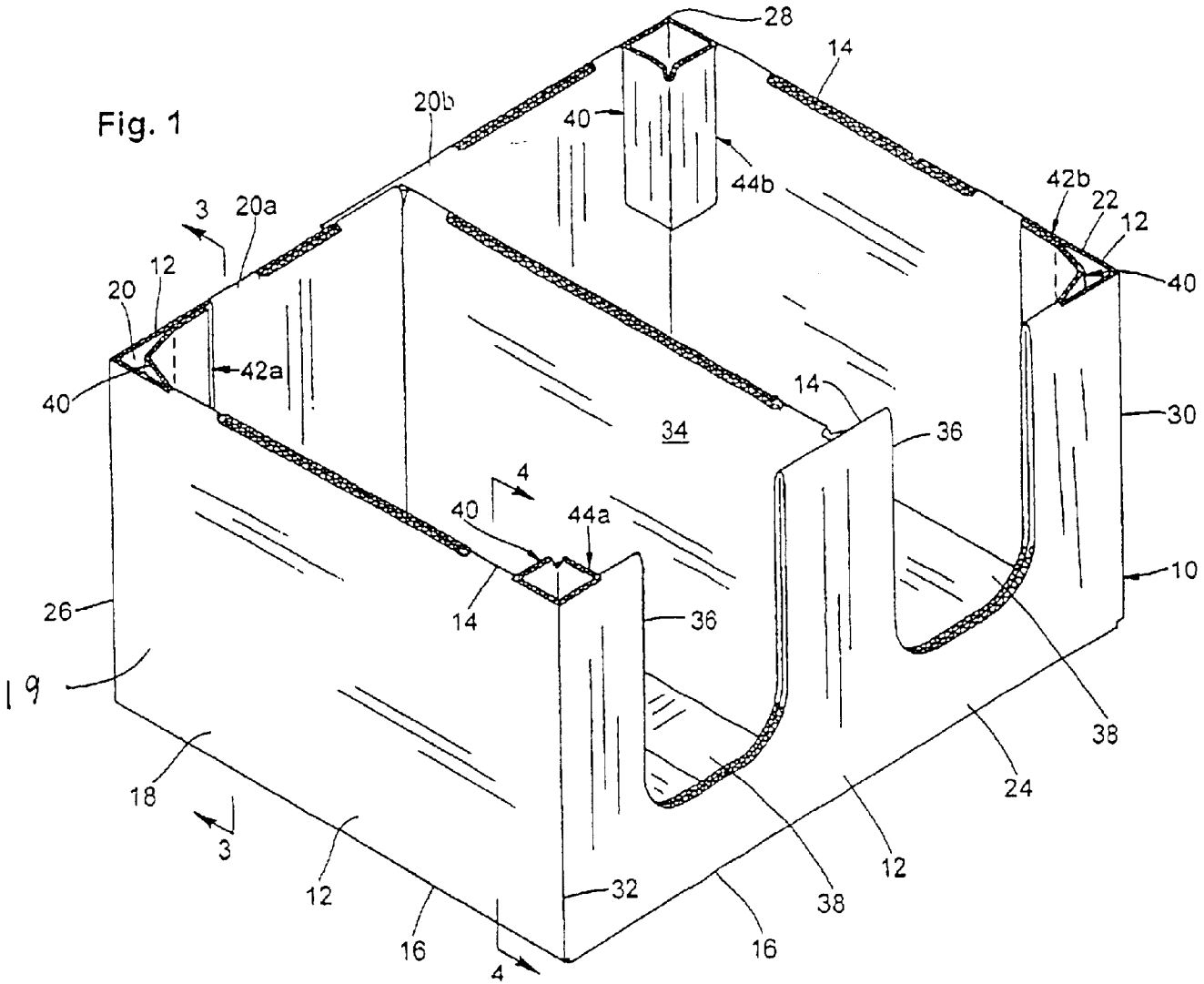
FIG. 1 is a perspective view of a container made in accordance with the present invention.

The invention disclosed herein is directed to a container having a novel means of strengthening for stacking and preventing nesting. Described below are preferred embodiments particularly suited for display-ready containers. It is recognized, however, that the present invention is adaptable to containers used for other purposes.

Illustrated with reference to FIGS. 1, 2, 3, and 4 is a display ready container 10 for shipping and displaying goods. The container 10 has multiple wall panels 12 integrally attached to one another to form the container sides. Each wall panel 12 has a top end 14, a bottom end 16, an inner face 17, and an outer face 19 as shown. In this particular example the multiple wall panels 12 include a first wall panel 18, a second wall panel 20, a third wall panel 22, and a fourth wall panel 24. The second wall panel 20 is formed from two partial panels 20*a*, 20*b* glued together during the manufacturing process in a manner known in the art.

The first and second wall panels 18 and 20 are attached at a first corner 26; the second and third wall panels 20 and 22 at a second corner 28; the third and fourth wall panels 22 and 24 at a third corner 30; and the fourth and first wall panels 24 and 18 at a fourth corner 32.

A divider wall 34 is integrally attached to an end of the partial wall panel 20*a* and adhesively attached to the fourth wall panel 24 to divide the container 10 into two sections as shown. Two display openings 36 provide visual display and access to the two sections formed by the divider wall 34.

Integrally attached along the bottom end 16 of the side wall panels 12 is a bottom formed by multiple bottom flaps 38. Partial bottom flaps 38*a* and 38*b*, integrally attached to partial wall panels 20*a*, 20*b* respectively, form the bottom flap 38 attached to the wall panel 20 (See FIG. 6). Many different types of container bottoms are known in the art; any suitable bottom may be used.

As best illustrated in FIGS. 1, 2, 3, and 4, corner supports 40 are provided adjacent each corner 26, 28, 30, and 32 to improve stacking strength and prevent nesting. The corner supports 40 reinforce each of the corners 26, 28, 30, and 32 and provide a second support surface in addition to the tops of the corners for supporting a container stacked on top. While all corners of the container 10 are shown with a corner support 40, it is readily understood that other embodiments having less than all corners reinforced are possible.

Figure 5:
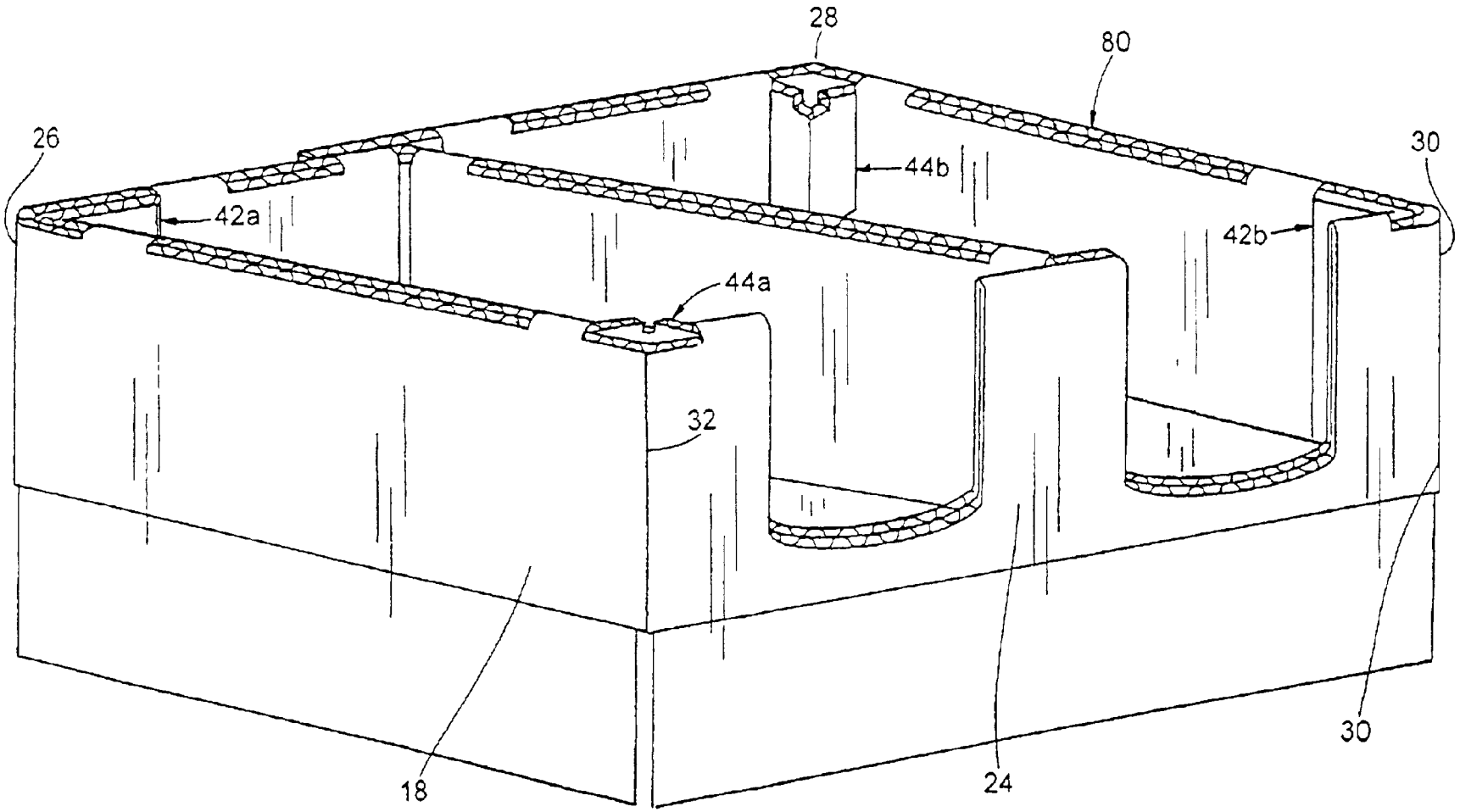
FIG. 5 is a perspective view of the container of FIG. 1 in its knockdown state shown partially opened.
Figure 5A:
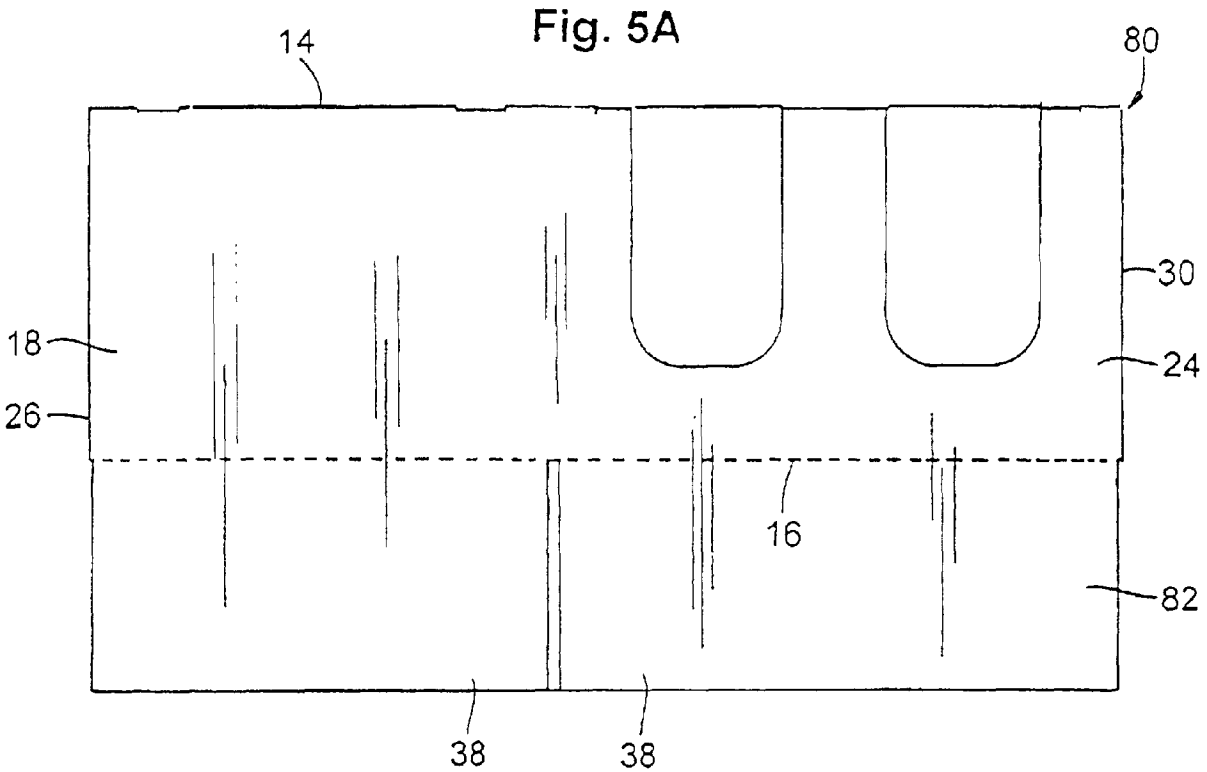
FIG. 5A is a side view of the container in its knockdown state.
Figure 5B:
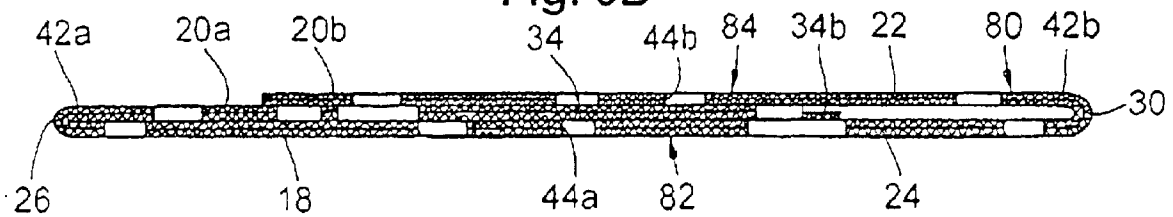
FIG. 5B is a top view of the knockdown shown in FIG. 5A.

Multiple configurations for the corner supports 40 are contemplated, with two particular preferred configurations being illustrated: a substantially non-rectangular corner support 42*a*, 42*b*, and a substantially rectangular corner support 44*a*, 44*b*. As further discussed below, the container 10 has a knockdown or collapsed state 80 as seen in FIGS. 5A and 5B ideal for shipping stacked empty containers. The particular corner supports 42*a*, 42*b*, 44*a*, 44*b* are preferred for this type of container 10 since they extend automatically into the positions shown in FIG. 1 upon assembly of the container from the knockdown state. This feature is discussed below with further description of the corner supports 40.

Figure 3:
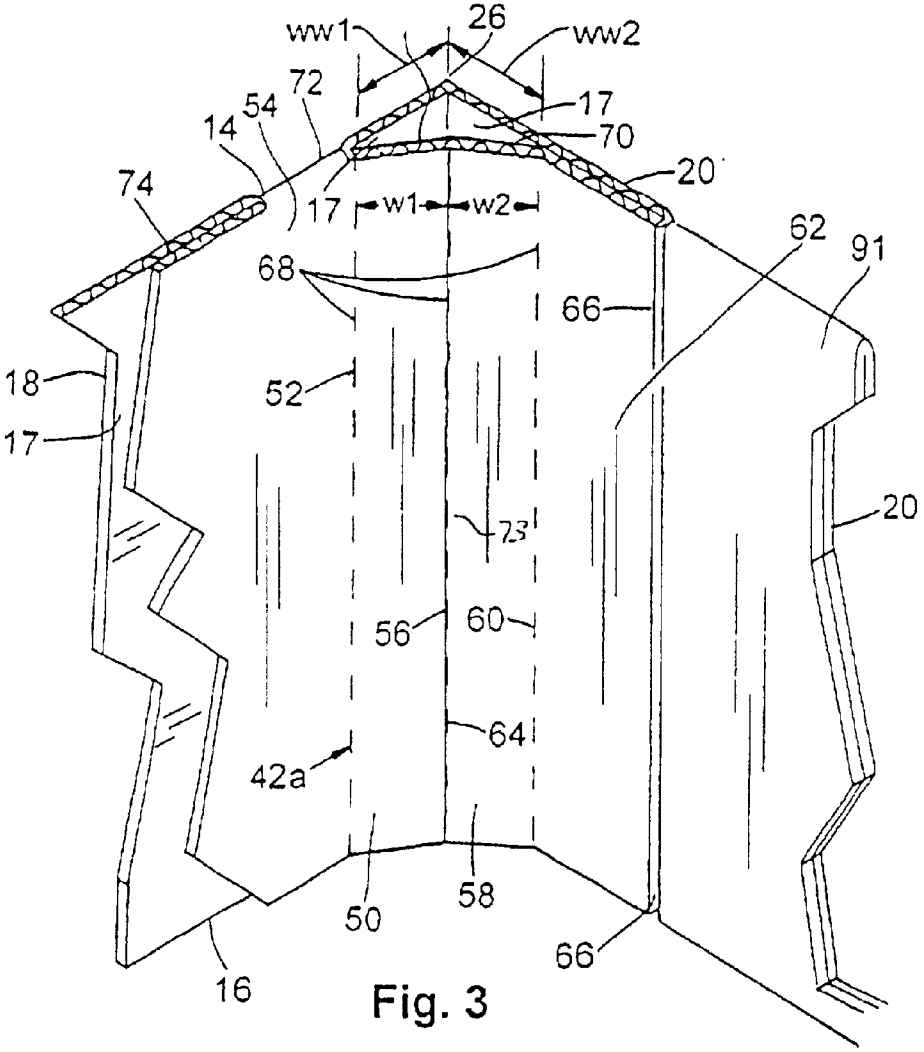
FIG. 3 is an enlarged sectional view taken along line 3—3 of FIG. 1.

With reference to FIGS. 1 and 3, the corner support 40 of the non-rectangular type 42*a*, 42*b*, has a first panel section 50 having a first end 52 attached pivotally to the inner face 17 of the first wall panel 18 between the first and fourth corners 26 and 32 respectively. In this embodiment, the first end 52 is attached pivotally to the inner face 17 by an attachment panel 54 which is attached to the inner face 17 of the first wall panel 18, preferably with an adhesive. The attachment panel 54 is integrally attached to the top end 14 of the first wall panel 18 and folded thereover onto the inner face 17 of the wall panel 18 and adhesively attached thereto with glue. The first panel section 50 of this embodiment is thus formed as an integral extension of the attachment panel 54. The first panel section 50 further has a second end 56 which is opposite the first end 52.

A second panel section 58 has a first end 60 attached pivotally to the inner face 17 of the second wall panel 20 between the first and second corners 26 and 28. (The panel sections 50 and 58 may also be referred to herein as "corner support panel sections"). In a like manner as with the first panel section 50, the second panel section 58 is attached pivotally to the inner face 17 through a second attachment panel 62 which is adhesively attached to the wall panel 20. The second panel section 58 further has a second end 64 opposite the first end 60 and attached pivotally to and contiguous with the second end 56 of the first panel section 50, the second end 64 and the second end 56 defining a corner edge 73 that is spaced from the adjacent corner 26 and the first and second side walls 18 and 20 as shown. As best seen in FIG. 3, the first panel section 50, the second panel section 58, and the second attachment panel 62 are integrally connected to one another and formed as an integral extension from the first attachment panel 54. This integral unit has an end 66 as shown. Fold lines 68, such as a line of perforations or a score, delineate the ends of the panel sections 50 and 58 and allow pivotal movement thereabout. Put another way, the internal support corners 42*a*, 42*b* are preferably formed of a unitary panel section having longitudinal fold lines 68 to delineate the various contiguous panels, i.e. the glue panel 54, the first panel section 50, the second panel section 58, and the second attachment panel 62.

Preferably, the upper edge 70 of both panel sections 50, 58 is co-elevational with the top end 14 of the wall panels 18, 20 to provide an additional support surface for a container stacked on top. The panel sections 50, 58 are also shown extending the full height of the wall panels 18, 20 from the bottom 16 to the top end 14.

The first glue panel 54 can take the form of a reinforcing panel covering a substantial portion of the inner face 17 of the front wall panel 18 as shown in the figures. Such reinforcing is disclosed, for example, in U.S. Pat. No. 3,731,873 which is hereby incorporated by reference. While such a large reinforcing panel offers added strength and works well with the illustrated embodiment, it is not required. The glue panel 54 could be smaller in width, although a suitable width for adequate gluing and strength should be maintained, e.g., the width of the second glue panel 62.

The top end 14, where the first glue panel 54 is integrally attached to the first wall panel 18, can be uncut as shown at 72, or cut as shown at 74 to reveal a cross section of both the wall panel 18 and glue panel 54 (both being corrugated as shown). A benefit of the cut sections 74 is that the wider edge formed by the cut can provide additional support surfaces for a container stacked on top.

With reference to FIG. 3, it is seen that the width "W1" of the first panel section 50 between the first end 52 and second end 56 along an inner face 17 (facing the corner 26) is less than the width "WW1" taken along the inner face 17 of the first wall panel 18 between the first end 52 and the first corner 26. Likewise, the width "W2" of the second panel section 58 between the first end 60 and the second end 64 along the inner face 17 is less than the width "WW2" taken along the inner face 17 of the second wall panel 20 between the first end 60 and the first corner 26. "W1" and "W2" are preferably substantially equal; "WW1" and "WW2" are likewise preferably substantially equal. The panel sections 50 and 58 are preferably sized and configured so that the center of the corner support 42*a* (end 56) is spaced from respective corner 26 as shown.

Figure 2:
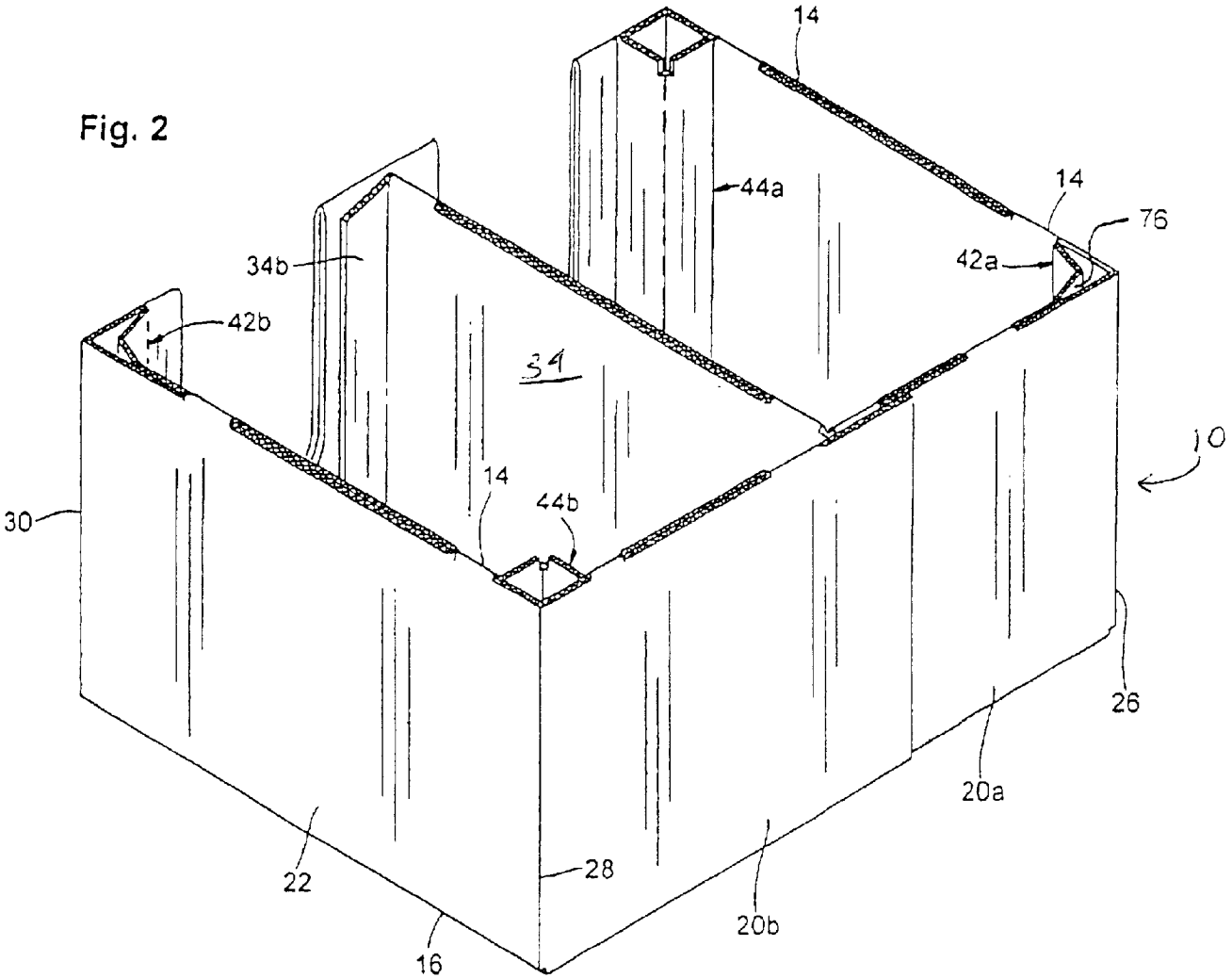
FIG. 2 is another perspective view of the container shown in FIG. 1.
Figure 4:
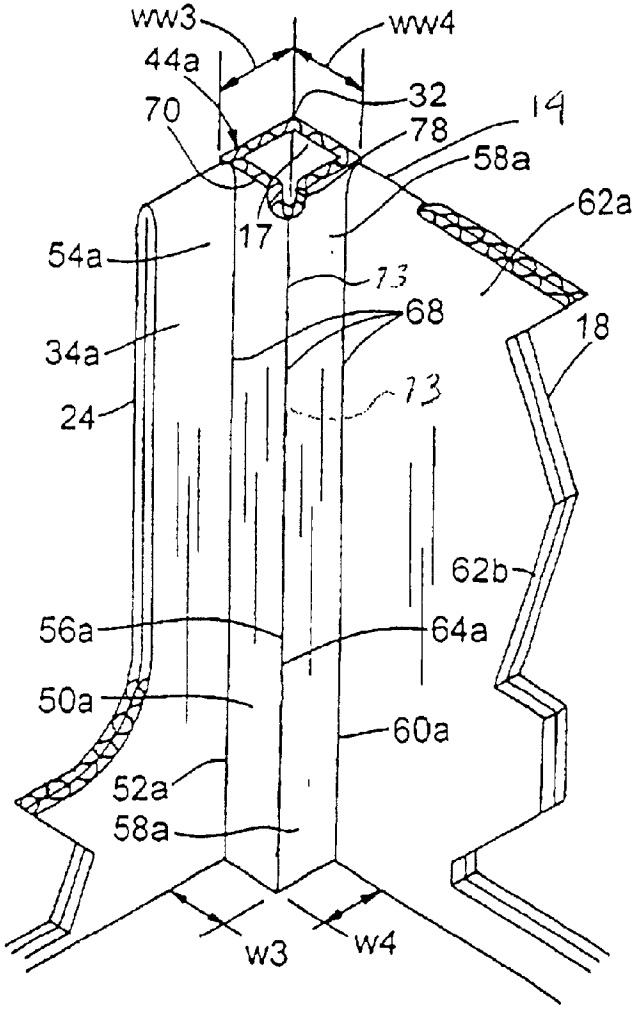
FIG. 4 is an enlarged sectional view taken along line 4—4 of FIG. 1.

The corner support 40 of the rectangular type 44*a*, 44*b* is now described with reference to FIGS. 1, 2 and 4. The rectangular corner support 44*a* has first and second panel sections 50*a*, 58*a*, each of the panel sections having respective first ends 52*a*, 60*a* as shown and respective contiguous second ends 56*a*, 64*a* pivotally and integrally connected to one another. The respective second ends 56*a*, 64*a* form the corner edge 73 which is spaced from the corner 32 and wall panels 18 and 24 as shown. The first end 52*a* of the first panel section 50*a* is attached pivotally to the fourth wall panel 24 between the third and fourth corners 30, 32 respectively, through a first integrally and pivotally attached attachment panel 54*a*; the first end 60*a* of the second panel section 58*a* is attached pivotally to the first wall panel 18 between the fourth and first corners 32, 26 respectively through an integrally and pivotally attached second glue panel 62*a*. Unlike the non-rectangular corner supports 42*a*, 42*b*, both of the first and second attachment panels 54*a*, 62*a* are integrally connected to the top end 14 of respective wall panels 24, 18 in this embodiment. The upper edge 70 of the panel sections 50*a*, 58*a* are co-elevational with the top end 14 of the wall panels 24, 18; the individual panel sections 50*a*, 58*a* being defined by fold lines 68. The length of the panel sections 50*a*, 58*a* may extend the full height of the wall panels 12, or shorter as illustrated by the corner support 44*b* seen in FIG. 1. The rectangular corner supports 44*a*, 44*b*, unlike the non-rectangular corners 42*a*, 42*b*, have a width "W3" and "W4" substantially equal to the respective widths "WW3" and "WW4" along the inner face 17 of the wall panels 24, 18 respectively between the ends 52*a*, 60*a* and the corner 32. This geometry is necessary for the knockdown state as further described below.

A further feature of the rectangular corner supports 44*a*, 44*b* is a tapered down shape 78 along the inside corner. This eliminates any sharp edges and prevents merchandise from getting caught on the corner edge when being dropped into the container 10 during loading.

The container 10 is preferably made from a unitary piece of single layer corrugated paperboard which is formed into a knockdown (collapsed) state 80 for easy stacking and shipment to the user. The term "knockdown" refers to the configuration of the container 10 in a flat unassembled form shown in FIGS. 5A and 5B (FIG. 5 showing the knockdown partially opened). The knockdown 80 has a first knockdown wall 82 and a second knockdown wall 84 attached to one another at the first and third corners 26 and 30. The first knockdown wall 82 includes the first and fourth wall panels 18 and 24, with the respective integral bottom flaps 38, in a substantially same plane, and the second knockdown wall 84 includes the second and third wall panels 20, 22 with respective integral bottom flaps in a second substantially same plane which is substantially parallel to the plane for the first knockdown wall 82. It is understood that the "substantially" same plane does not mean the exact same plane. The divider wall 34 is sandwiched between and substantially parallel to the knockdown walls 82 and 84.

To assemble the knockdown 80 into the display ready container 10, the two knockdown walls 82 and 84 are pushed apart and folded to form the corners 32 and 28 and create the basic shape of the container 10 (see FIG. 5 showing the knockdown 80 partially opened). The container bottom flaps 38 are then folded.

Figure 6:
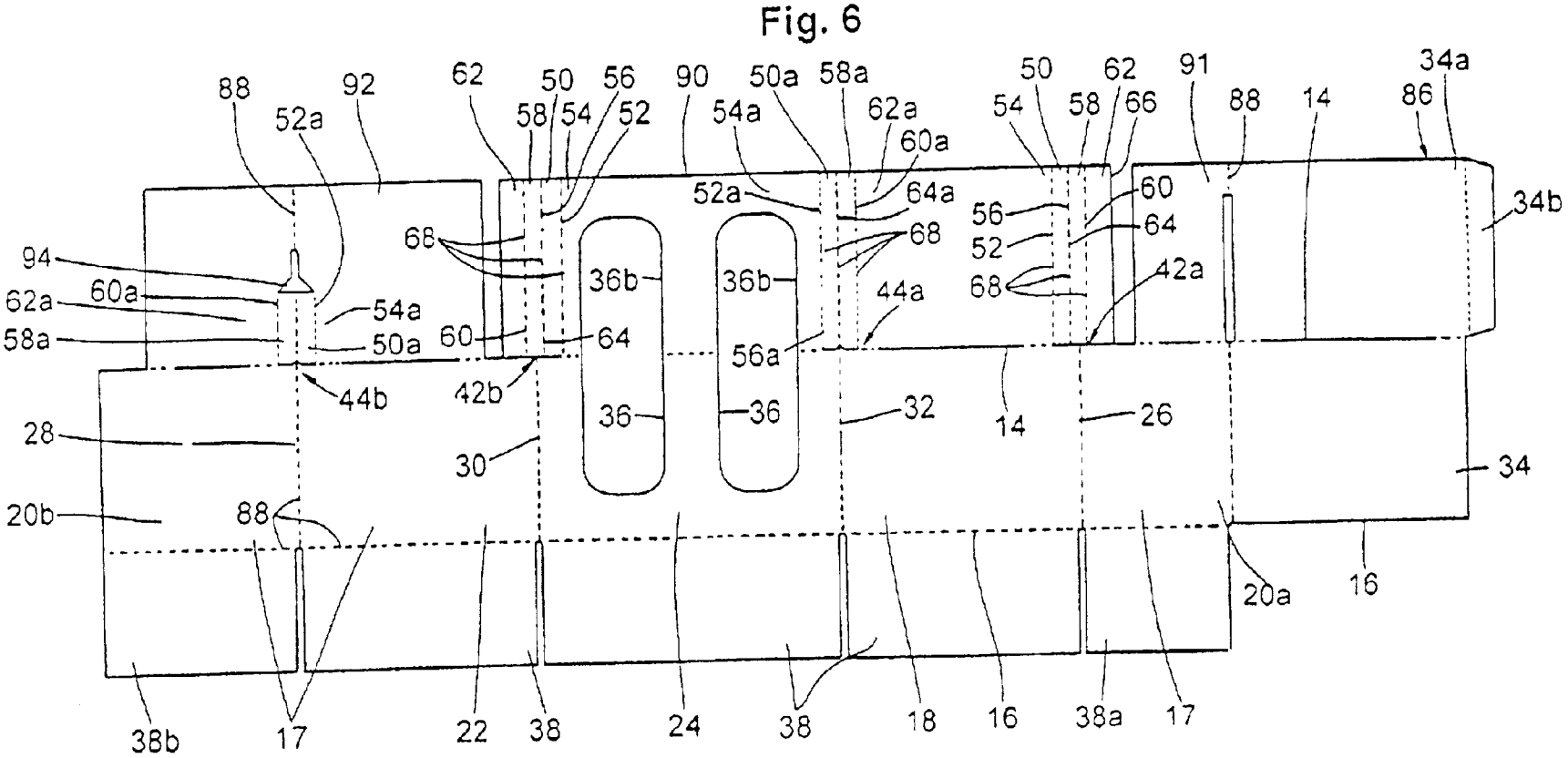
FIG. 6 is a plan view of a blank for forming the container shown in FIG. 1.

Illustrated in FIG. 6 is a blank 86 for forming the knockdown 80 and the container 10. The blank 86 is preferably a unitary piece of material such as single layer corrugated paperboard die cut to form the configuration shown. The view of FIG. 6 shows the inner face 17 of the integrally attached wall panels 18, 20*a*, 20*b*, 22, and 24 with respective bottom flaps 38 integrally attached thereto. The divider wall 34 has an integrally connected reinforcing panel 34*a* having a glue tab 34*b*, and is attached to a reinforcing panel 91 which folds over the top end 14 to reinforce panel 20*a*.

For the non-rectangular corner support 42*a*, the first attachment panel 54 (on the right side of the reinforcing panel 90), the first and second panel sections 50 and 58, and the second attachment panel 62 are defined by perforated fold lines 68. The top end 14 of the wall panels 18 and 20 adjacent the first and second panel sections 50, 58 and second attachment panels 62 is cut to allow pivotal movement about the first edge 52 of the first panel section 50. The non-rectangular corner support 42*b* is likewise constructed.

The rectangular corner support 44*a* has a first attachment panel 54*a* that, in this embodiment, is in the middle of the reinforcing panel 90 which also serves as the first attachment panel 54 for the non-rectangular corner support 42*b* on the left side of the reinforcing panel 90. The reinforcing panel 90 also has display openings 36*b* conforming to display openings 36 on the fourth wall panel 24 to align therewith when folded about the top end 14. Viewing the corner support 44*a*, the first panel section 50*a* is integrally connected to and separated by a perforated fold line 68 from the first attachment panel 54*a*, followed by the second panel section 58*a*, in turn followed by the second attachment panel 62*a* which here also serves as the first attachment panel 54 for the non-rectangular corner support 42*a*. The reinforcing panel 90 is a single piece that forms the various panels for the non-rectangular corner supports 42*a*, 42*b* and the rectangular corner support 44*a*.

The rectangular corner support 44*b* is formed on a reinforcing panel 92 and has a slot 94 (cut out) which allows easy pop out of the corner support 44*b* during assembly from the knockdown 80 to the final container 10. Again, the present embodiment is shown with reinforcing panels 90, 92 which may not be necessary. Without such reinforcing panels, the various attachment panels 54, 62 and 54*a*, 62*a*, could still be integrally connected to the top end 14 of the wall panels, if desired, although the attachment panel would be smaller in width.

Figure 7:
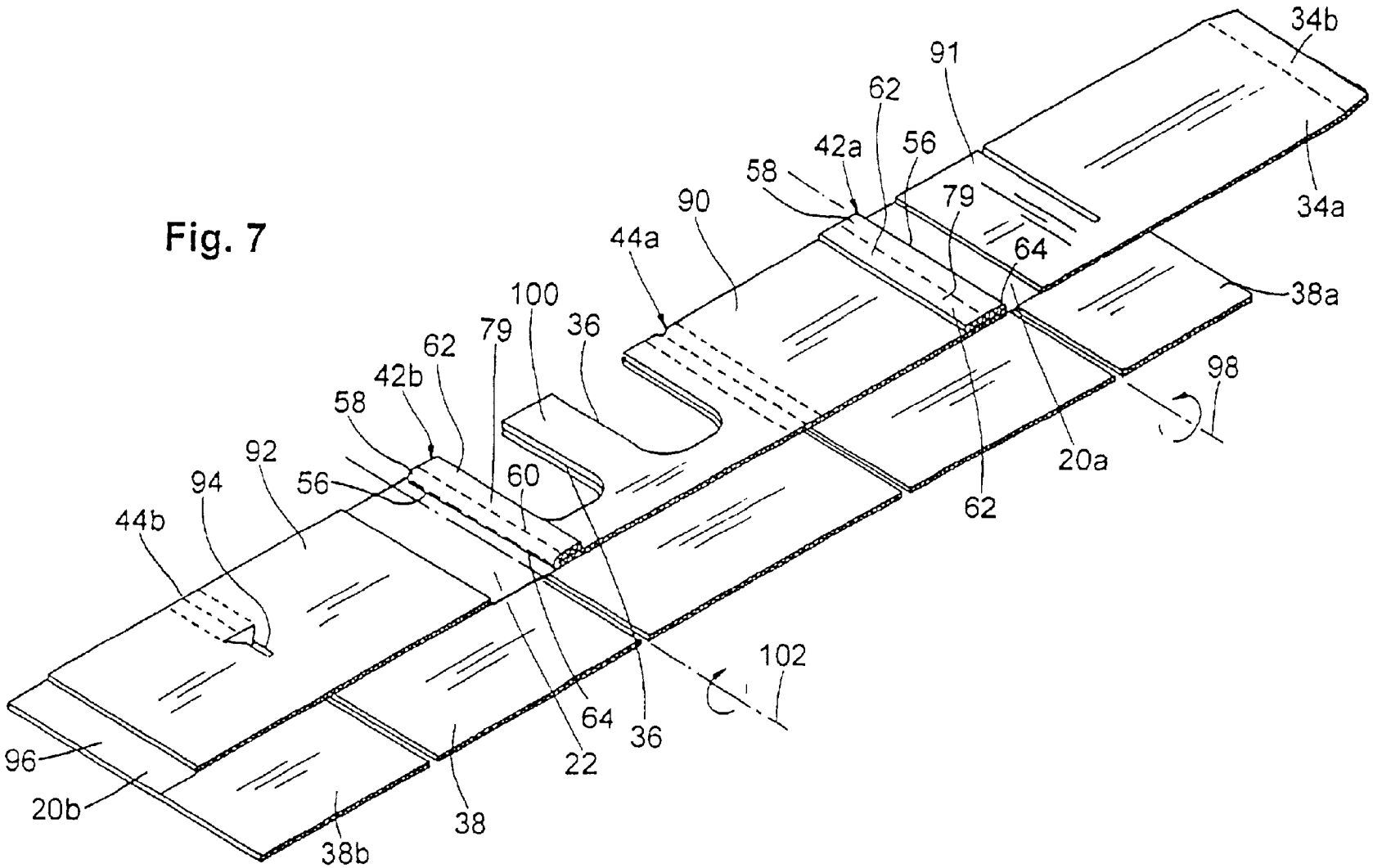
FIG. 7 is a perspective view of the blank of FIG. 6 shown partially assembled for forming the knockdown shown in FIGS. 5A and 5B.

The blank 86 can be assembled into the knockdown 80 and the final container 10 as now described with reference to FIGS. 5, 6 and 7. With the blank 86 in a flat position as shown in FIG. 6, the reinforcing panels 90 and 92 and divider reinforcing panel 34*a* (with reinforcing panel 91) are folded about the top end 14 and secured with glue to the inner face 17 of the respective wall panels 18, 20*a*, 20*b*, 22, 24 and divider panel 34. It is important not to glue the panel sections 50, 58 of the non-rectangular corner supports 42*a*, 42*b* and the panel sections 50*a*, 58*a* of the rectangular corner supports 44*a*, 44*b* as these must be free to pivot. Next, as shown in FIG. 7, for the non-rectangular corner supports 42*a* and 42*b*, the second panel sections 58 and second attachment panel 62 are folded 180 degrees as shown about the second edge 64 of the second panel section 58. The second ends 64 are offset from the corners 26 and 30 as shown in FIG. 6. Glue is then applied to the outer face 79 of the attachment panel 62, the glue tab area 96 of wall panel 20*b*, and the glue tab 34*b*.

The wall panel 20*a* and divider panel 34 (with the reinforcing panels secured thereto) and the partial bottom flap 38*a* integrally attached thereto are then folded, all as a single flat unit about the line 98 as indicated (corner 26) onto the other panels (FIG. 7). The glue tab 34*b* of the divider reinforcing panel 34*a* is secured with the glue to the area 100 between the two display openings 36, and the second attachment panel 62 of corner support 42*a* attached to the wall panel 20*a*. The wall panels 20*b* and 22 with reinforcing panel 92 secured thereto and respective bottom flaps 38 and 38*b* are then folded as a flat unit about line 102 (corner 30) and the glue tab 96 is secured with the glue to the back side of the partial wall 20*a* and the bottom partial flap 38*b* to partial bottom flap 38*a* to form the complete wall panel 20 and respective bottom flap, and the second attachment panel 62 of the non-rectangular corner support 42*b* is secured to the wall panel 22. This forms a knockdown 80 which can be opened and assembled into the container 10 of FIG. 1.

With reference to FIG. 5, it is seen that the opening of the knockdown 80 to form the container 10 automatically extends the corner supports of both types 42*a*, 42*b*, and 44*a*, 44*b*. With respect to the non-rectangular corner supports 42*a*, 42*b*, it is seen that in the knockdown state the first and second panel sections 50 and 58 are folded face-to-face in a flat folded position (an angle of substantially 0 degrees between them) and sandwiched between the two knockdown walls 82, 84. Opening the knockdown, i.e., as the angle of corner 26 goes from 0 degrees (knockdown) to 90 degrees (FIG. 1), the panel sections 50, 58 extend away from the first corner 26 to form the polygon shape as seen in FIG. 1.

With respect to the rectangular corner support 44*a*, it is seen that in the knockdown state 80, the two panel sections 50*a*, 58*a* are in a substantially same plane relative to one another (an angle of substantially 180 degrees between them) sandwiched between and substantially parallel to the first and second knockdown walls 82, 84. Opening the knockdown 80, the two panel sections 50*a* and 58*a* extend into the position shown in FIG. 4, extended from the corner and forming the rectangular shape as shown.

Figure 8:
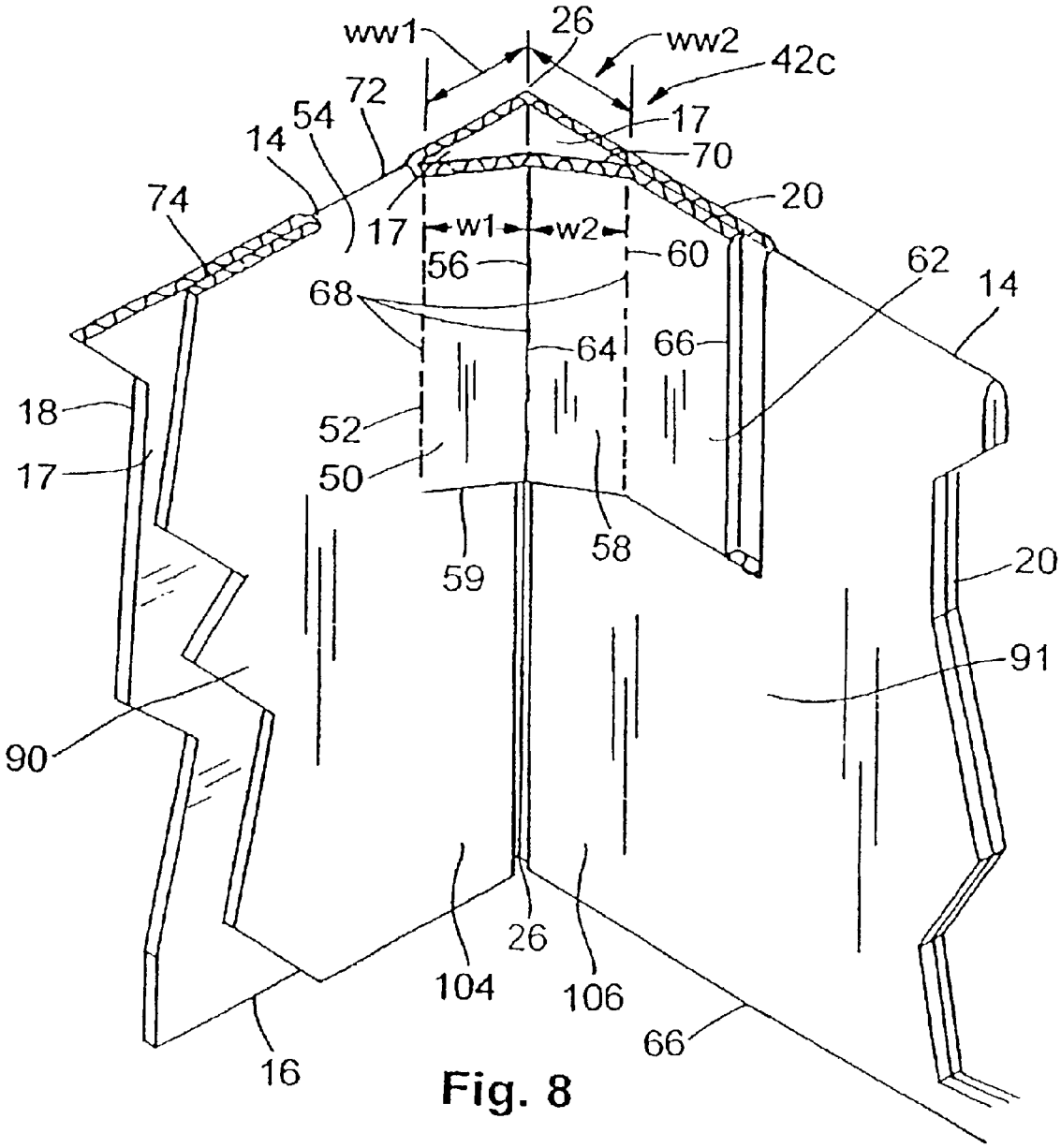
FIG. 8 is a perspective view of another embodiment of a corner support made in accordance with the present invention.
Figure 9:
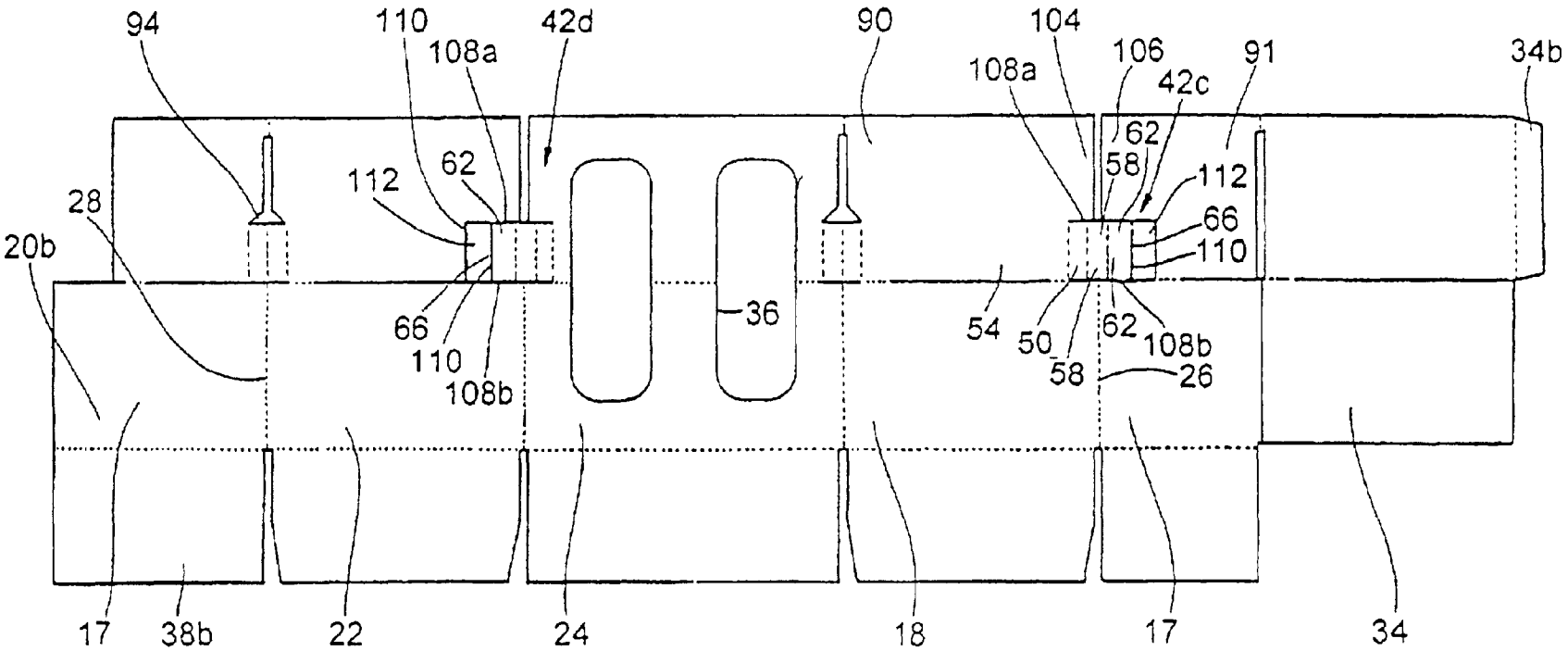
FIG. 9 is a plan view of a blank for forming a container having the corner support shown in FIG. 8.

Illustrated in FIGS. 8 and 9 is another embodiment of the corner supports 40 of the non-rectangular type. A corner support 42*c* is similar to that of the support 42*a* of FIG. 3, with similar elements being referenced with the same reference number. The height of the first and second panel sections 50 and 58 of the corner support 42*c* are substantially less than the height of the adjacent wall panels 18 and 20, the corner support 42*c* having a lower edge 59 as shown. The first end 52 of the first panel section 50 is attached pivotally to the inner face 17 of the first wall panel 18 via the attachment panel 54 in a like manner as shown and described with reference to FIG. 3. Here, however, the attachment panel 54 has a lower section 104 that extends below the lower edge 59 of the corner support 42*c* to the corner 26 (see FIG. 9). The first end 60 of the second panel 58 is pivotally attached to the inner face 17 of the second wall panel 20 via the second attachment panel 62. The reinforcing panel 91, folded over at the top end 14 and glued to the panel 20, has a lower section 106 that extends below the lower edge 59 of the corner support 42*c* to the corner 26 (see FIG. 9).

With reference to FIG. 9, it is seen that the corner support 42*c* is formed and cut from the first attachment panel 54 (here a reinforcing panel) and reinforcing panel 91 by making horizontal cuts 108*a*, 108*b* (the cut 108*a* forming the lower edge 59 of the corner support 42*c*) and a vertical cut 110 (forming the end 66) to leave a cut-out 112.

The container is formed into the knockdown state in a manner similar to that described with reference to FIGS. 6 and 7. It is believed that the non-rectangular corner support 42*c*, although less in height that the support corners 42*a* and 42*b* of FIG. 1, provide for a stronger container having a higher stacking strength. Furthermore, it has been found that this container folds easier and runs on packing machines better than containers with the larger height corner supports of 42*a* and 42*b*.

Further modifications have been found to increase the successful deployment of the corner support 40 of the rectangular type 44*a*, 44*b*. While such corner supports should open or pop-out to a position spaced away from the container corner when the container is assembled from the knockdown state, it has been found that such rectangular corner supports may sometimes fold into the container corner and thus fail to deploy into its spaced position as desired. To assure a high success rate of deployment of the corner support 44*a*, 44*b*, additional features can be added as described below.

Intermediate Panel Type Corner Support

Figure 10:
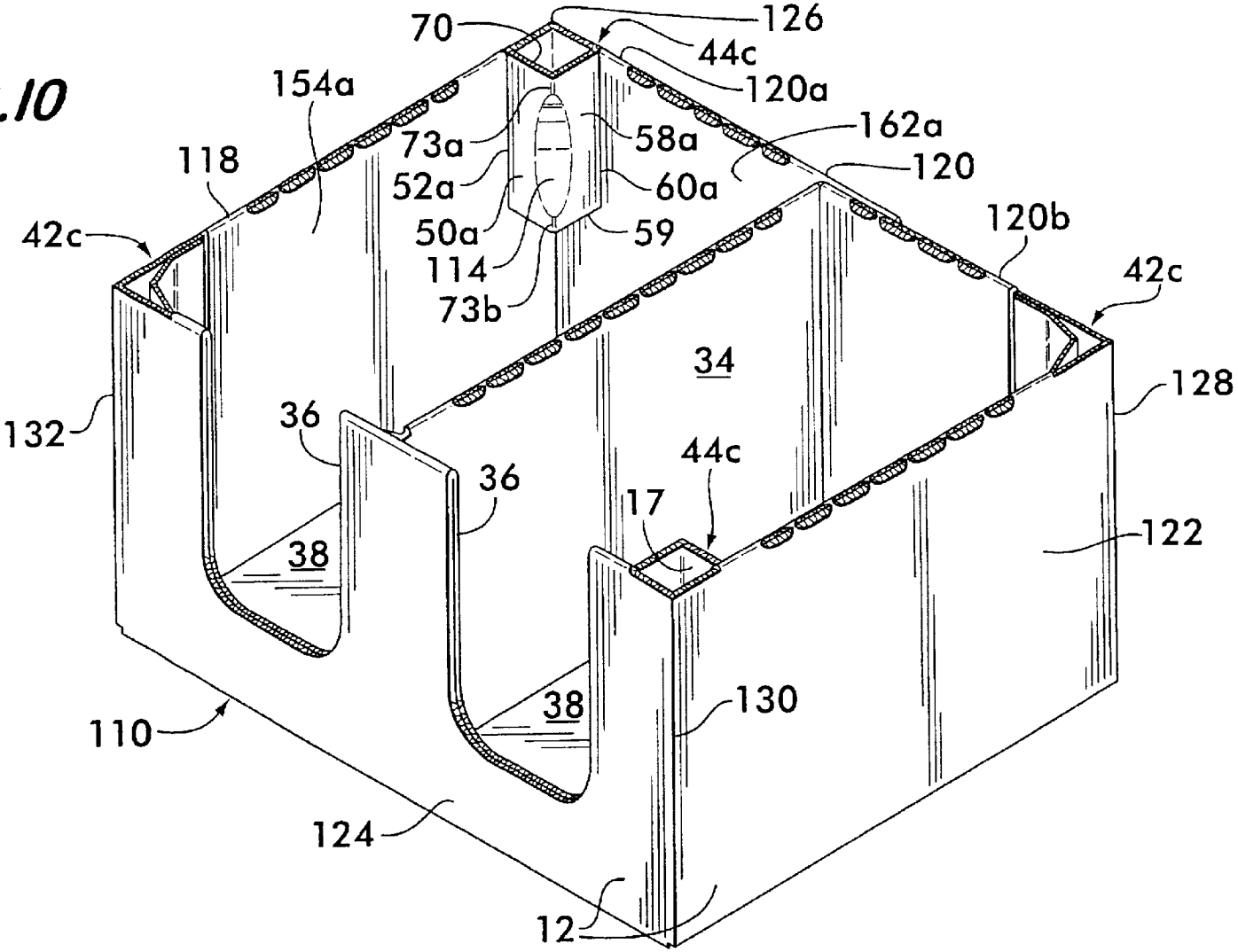
FIG. 10 is a perspective view of another embodiment having a support corner with an intermediate panel.
Figure 12:
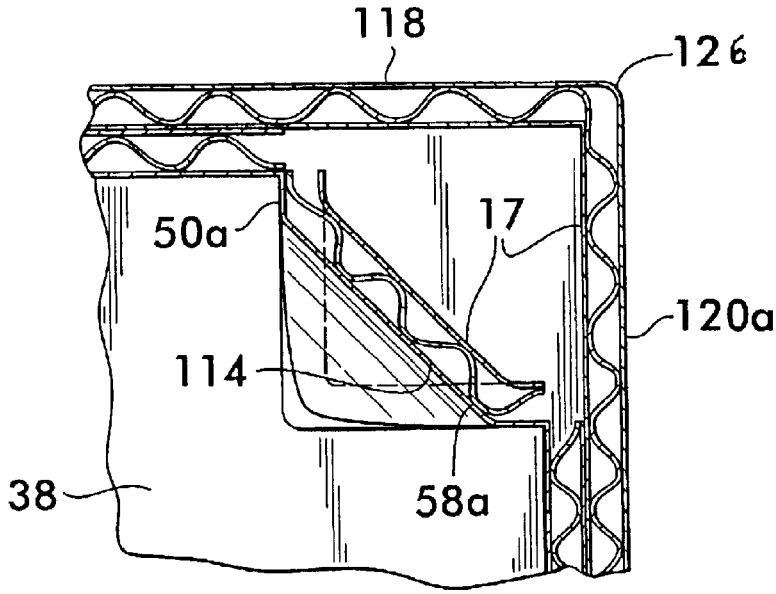
FIG. 12 is a sectional view taken along line 12—12 of FIG. 11.

With reference to FIGS. 10, 1, and 12, a container 110 having rectangular corner supports 44*c* with an intermediate panel is now described. The corner supports 44*c* are similar to the corner supports 44*a* and 44*b* with similar elements being referenced with the same reference numbers. The multiple wall panels 12 include a first wall panel 118, a second wall panel 120, a third wall panel 122, and a fourth wall panel 124. The second wall panel 120 is formed from two partial panels 120*a*, 120*b*. The first and second wall panels 118 and 120 are attached at a first corner 126; the second and third wall panels 120 and 122 at a second corner 128; the third and fourth wall panels 122 and 124 at a third corner 130; and the fourth and first wall panels 124 and 118 at a fourth corner 132.

A divider wall 34 is integrally attached to an end of the partial wall panel 120*b* and adhesively attached to the fourth wall panel 124. Two display openings 36 are provided. Bottom flaps 38 are provided as shown.

Substantially non-rectangular corner supports 42*c*, similar to that disclosed above, are provided. The substantially rectangular corner supports 44*c* contain an additional intermediate panel which is now described in more detail with reference to one of the corner supports 44*c* shown in FIGS. 11 and 12.

The rectangular corner support 44*c* has first and second panel sections 50*a*, 58*a*, each panel section having a respective first end 52*a*, 60*a* and a respective second end 56*a*, 64*a* opposite their first end 52*a*, 60*a* as shown. The first end 52*a* of the first panel section 50*a* is attached pivotally to the first wall panel 118 between the first and fourth corners 126, 132 respectively through a first integrally and pivotally attached attachment panel 154*a*; the first end 60*a* of the second panel section 58*a* is attached pivotally to the second wall panel 120 between the first and second corners 126, 128 respectively through an integrally and pivotally attached second attachment panel 162*a*. Both of the first and second attachment panels 154*a*, 162*a* are integrally connected to the top end 14 of respective wall panels 118, 120. The respective second ends 56*a*, 64*a* are pivotally and integrally connected to one another and form the corner edge 73 which is spaced from the first and second wall panels 118 and 120 as shown. The upper edges 70 of the panel sections 50*a*, 58*a* are co-elevational with the top end 14 of the wall panels 118, 120; the individual panel sections 50*a*, 58*a* being defined by fold lines 68. Here, the first and second panel sections 50*a* and 58*a* have respective widths "W3" and "W4" substantially equal to the respective widths WW4 (opposite W3) and WW3 (opposite W4) of the wall panels 118, 120 respectively between the ends 52*a*, 60*a* and the corner 126, forming a rectangular shape, and in particular a square shaped corner support.

A substantially planar intermediate panel 114 is positioned between the upper edge 70 and the lower edge 59 of the corner support 44*c*. The intermediate panel 114 has a height H1 less than the height H2 of the corner edge 73, breaking the continuity of the corner edge 73 between the upper and lower edges 70, 59 of the corner support 44*c*.

In the illustrated embodiment, the corner edge 73 has a first edge section 73*a* extending between the upper end 116*a* of the intermediate panel 114 and the upper edge 70 of the corner support, and a second edge section 73*b* extending between the lower end 116*b* of the intermediate panel 114 and the lower edge 59 of the corner support. The intermediate panel 114 is preferably arcuate in shape and symmetrical about the corner edge 73 as shown (here almond or elliptically shaped). To form the intermediate panel 114, a creased or scored fold line 117 (see FIG. 13) is made on the inner face 17 (facing the corner 126) of the corner support 44*c*. It is believed that upon assembly of the container 110 from the knockdown form, the intermediate panel 114 and the crease scored fold line 117 force the corner support 44*c* away from the corner 126 thereby increasing the likelihood that the corner support 44*c* will open as desired.

For an almond shaped intermediate panel 114 as shown, the corner support height H2 between the upper and lower edges 70, 59 is preferably between about 4 to about 6 inches, the intermediate panel height H1 is preferably no smaller then about 3 inches, and a preferred ratio of intermediate panel height H1 to intermediate panel width W5 is about 3 to 1. One preferred configuration for a container made of B flute material (⅛ inch thick) having an almond or elliptically shaped support corner 44*c* is as follows: a corner support height H2 of 4½ inches; a corner support 44*c* width of 2 inches (sum of W3 (one inch) and W4 (one inch)); an intermediate panel height H1 of 3½ inches (the first and second edge sections 73*a*, 73*b* each having a length of ½ inch); an intermediate panel 114 width W5 of one inch. Other preferable configurations for almond like panel shapes include an H1 of three inches, a W5 of one inch, and an H2 of four inches. Alternatively, for the almond shaped intermediate panel, the first and second edge sections 73*a*, 73*b* can each have lengths longer than one-half inch, up to 1 inch being desirable in some configurations.

Figure 13:
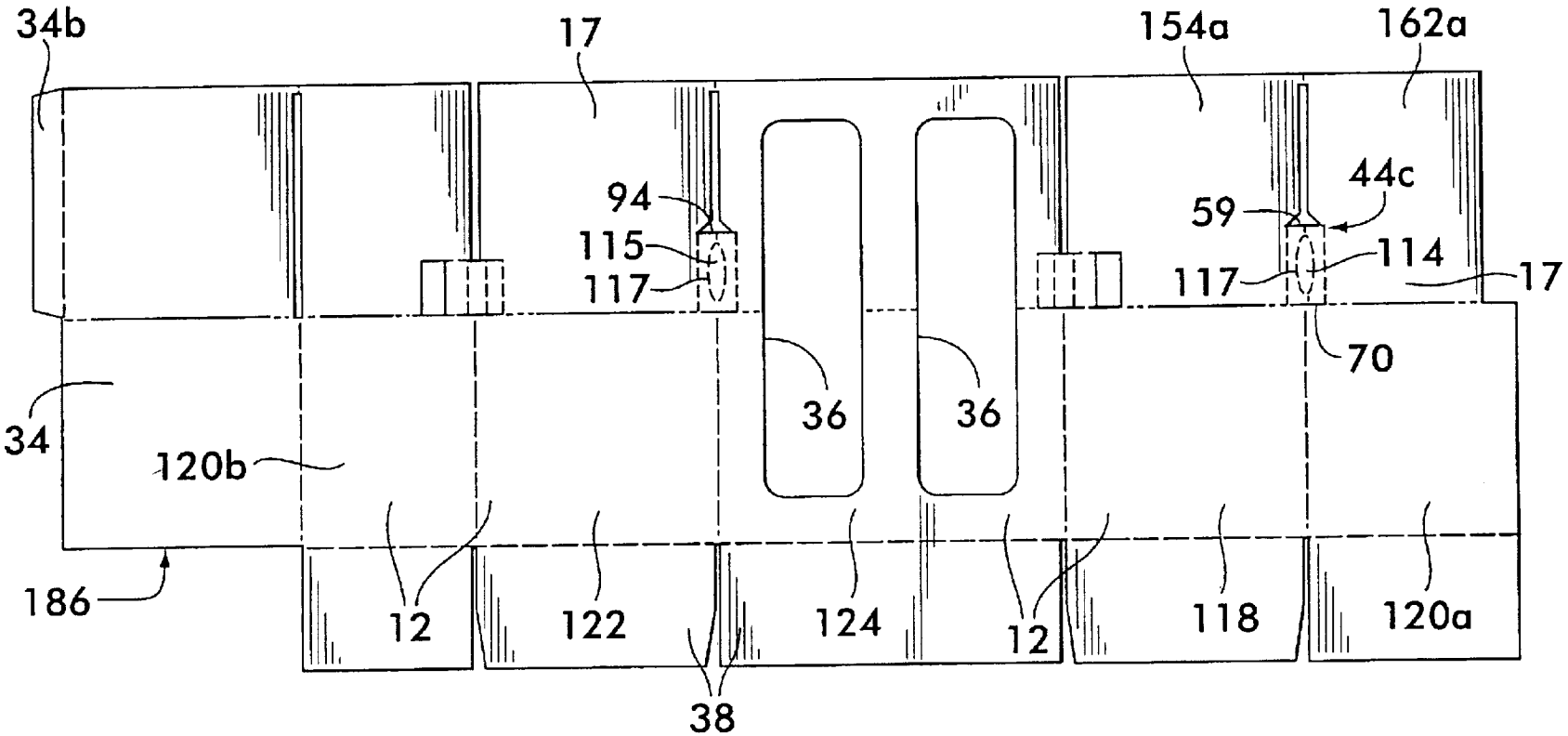
FIG. 13 is a blank which can be assembled to form the container of FIG. 10.

A blank 186 for forming a knockdown, and ultimately the container 110, is shown in FIG. 13. The scored fold line 117 and the score line for the corner edge 73 are formed on the inner face 17 as shown. The blank is folded into a knockdown in a manner similar to that described above.

Offset Corner Support

Figure 14:
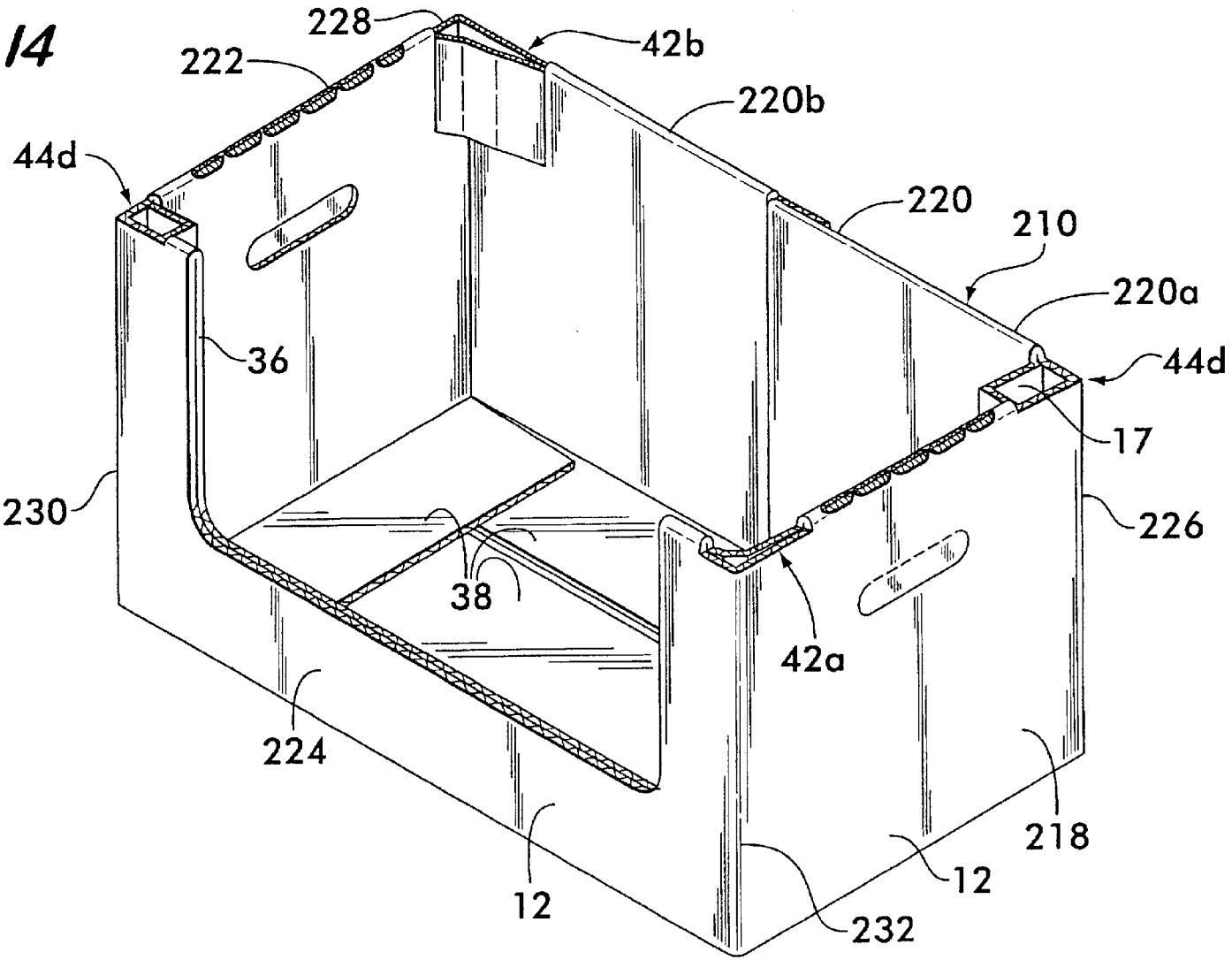
FIG. 14 a perspective view of yet another embodiment of the invention having an offset style support corner.
Figure 15:
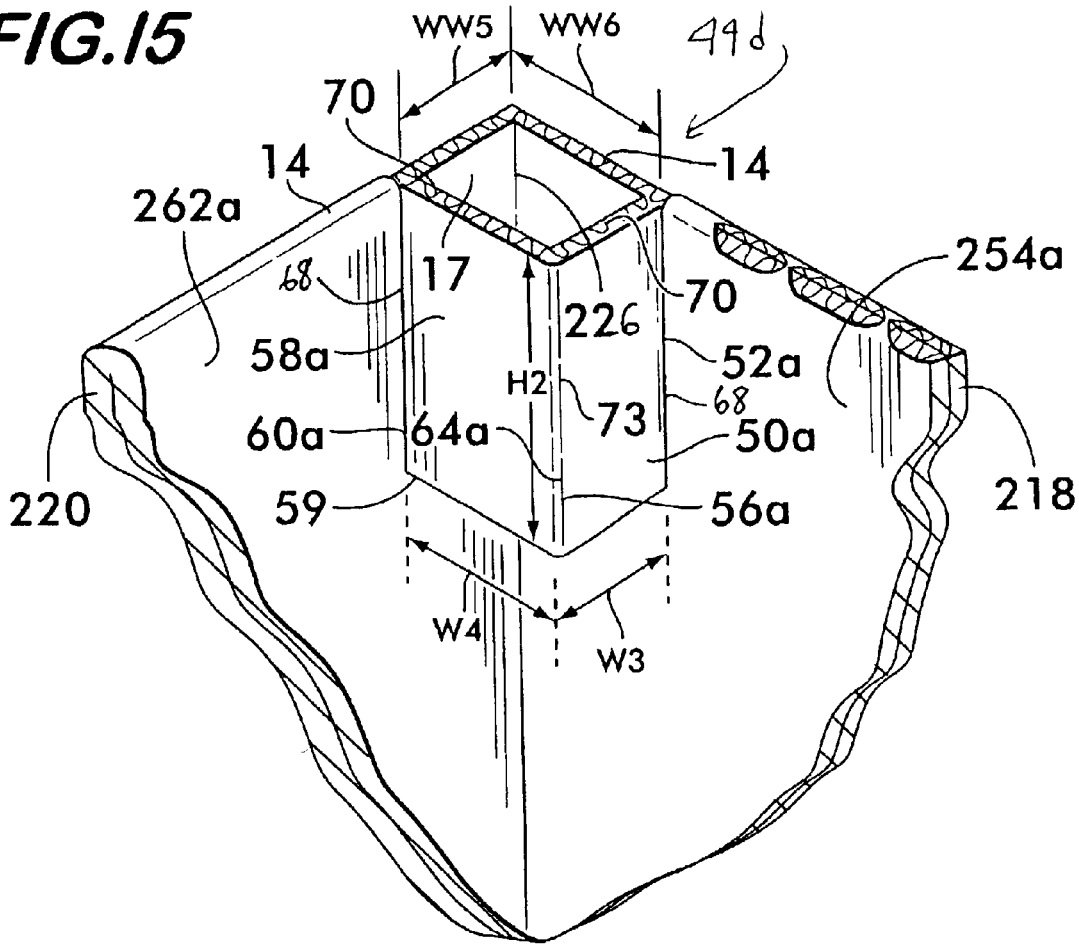
FIG. 15 is an enlarged view of a support corner of FIG. 14.
Figure 16:
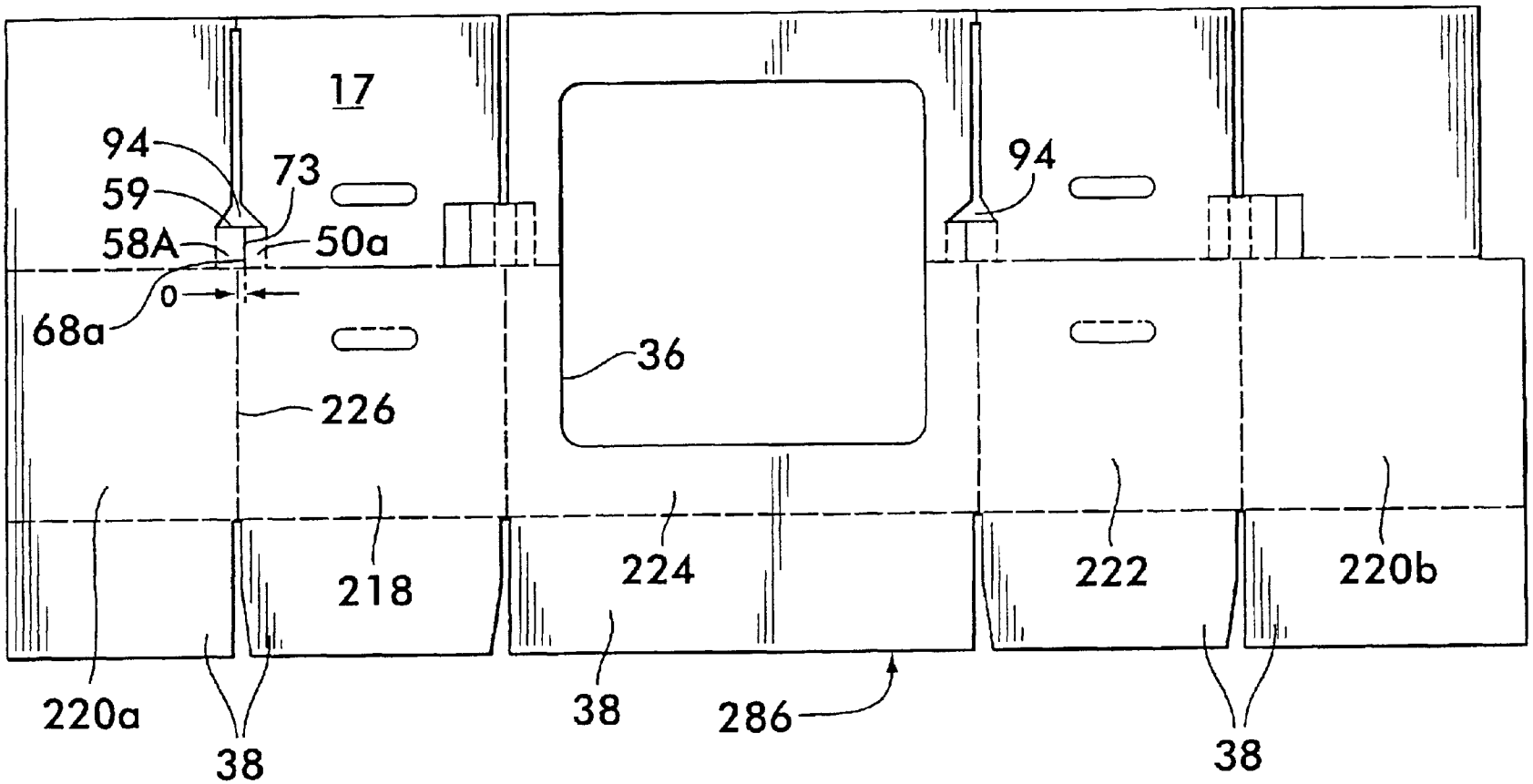
FIG. 16 is a blank which can be assembled to form the container of FIG. 14.

With reference to FIGS. 14, 15, and 16, a container 210 having rectangular corner supports 44*d* with an offset configuration is now described. The corner supports 44*d* are similar to the corner supports 44*a* and 44*b* with similar elements being referenced with the same reference numbers. The multiple wall panels 12 include a first wall panel 218, a second wall panel 220, a third wall panel 222, and a fourth wall panel 224. The second wall panel 220 is formed from two partial panels 220*a*, 220*b*. The first and second wall panels 218 and 220 are attached at a first corner 226; the second and third wall panels 220 and 222 at a second corner 228; the third and fourth wall panels 222 and 224 at a third corner 230; and the fourth and first wall panels 124 and 118 at a fourth corner 232.

A single display opening 36 and bottom flaps 38 are provided as shown.

Substantially non-rectangular corner supports 42*a*, 42*b* are similar to those described above. The substantially rectangular corner supports 44*d* have a corner edge 73 (see FIG. 15) that is offset from the adjacent container corner and is now described in more detail with reference to one of the corner supports 44*d* in the FIGS. 14, 15, and 16, and with particular reference to FIG. 15.

The rectangular corner support 44*d* has first and second panel sections 50*a*, 58*a*, each of the panel sections having a respective first end 52*a*, 60*a* and a respective second end 56*a*, 64*a* as shown. The first end 52*a* of the first panel section 50*a* is attached pivotally to the first wall panel 218 between the first and fourth corners 226, 232 respectively through a first integrally and pivotally attached attachment panel 254*a*; the first end 60*a* of the second panel section 58*a* is attached pivotally to the second wall panel 220 between the first and second corners 226, 228 respectively through an integrally and pivotally attached second attachment panel 262*a*. Both of the first and second attachment panels 254*a*, 262*a* are integrally connected to the top end 14 of respective wall panels 218, 220. The respective second ends 56*a*, 64*a* are pivotally and integrally connected to one another and form the corner edge 73. The upper edge 70 of the corner support 44*d* (and panel sections 50*a*, 58*a*) are co-elevational with the top end 14 of the wall panels 218, 22. The individual panel sections 50*a*, 58*a* are defined by fold lines 68, such as crease scores; the score for the corner edge 73 should be placed on the inner face 17 of the corner support 44*d*.

Here, the rectangular corner support 44*d* is not square as shown in the embodiments of FIGS. 1 and 10, but rectangular, i.e., the width W3 is different from the width w4 (and WW5 likewise is different from WW6). This causes the corner edge 73 to be offset—not aligned with the adjacent container corner 226 when the container is in the knockdown form (see the blank in FIG. 16 where the length of the offset O can be seen prior to folding of the panels into the knockdown form). Because the crease of the support corner edge 73 does not align with the adjacent container corner 226, the corner support 44*d* has no place to open but away from the corner 226, thereby assuring a high success rate of opening.

One preferred configuration for a box of B flute material (⅛ of an inch thickness) is a corner support 44*d* having widths W3 and W4 for first and second panel sections 50*a*, 58*a* of 1 and 1½ inches respectively with an offset of ½ inch (WW5 and WW6 also being about 1 and 1½ inches respectively for the rectangular shape of the corner support); and a length H2 of 2 inches. Another preferred configuration is a W3 and W4 of 1 and ¾ inches respectively, with an offset O of ¼ inch (B flute material). In general, the offset length O (FIG. 16) is preferably between about ¼ to about ¾ of an inch for B flute board, and preferably between about 3/16 to about ½ of an inch for E flute board (1/16 inch), it being seen that the offset O is the difference between the widths W3 and W4.

A blank 286 for forming a knockdown, and ultimately the container 210, is shown in FIG. 16. The scored fold line 68*a* which defines the corner edge 73 is preferably formed on the inner face 17 as shown. The blank is folded into a knockdown in a manner similar to that described above.

While particular embodiments of the invention are described herein, it is not intended to limit the invention to such disclosure. Changes and modifications may be incorporated and embodied within the scope of the appended claims. Moreover, the designation of "first," "second," etc., for the various panels and members is not limited to the particular panels or members shown herein.

What is claimed is:

1. A container that can be assembled from a knockdown form, comprising:

multiple wall panels attached to one another to form the container sides, said wall panels including a first wall panel and a second wall panel attached to one another at a first corner, each of said first and second wall panels having an inner face and a top end;

a first attachment panel attached to said first wall panel;

a second attachment panel attached to said second wall panel;

a corner support having upper and lower edges, a corner edge spaced from said first and second wall panels, and first and second panel sections;

said first panel section having a first end attached pivotally to said first attachment panel and a second end opposite said first end; and said second panel section having a first end attached pivotally to said second attachment panel and a second end opposite said first end of said second panel section, said second end of said first panel section and said second end of said second panel section being attached pivotally to each other at said corner edge.

2. A container in accordance with claim 1 wherein said upper edge of said corner support is substantially co-elevational with said top end of said first wall panel.

3. A container in accordance with claim 2 wherein said first and second panel sections have a height substantially less than a height of said first wall panel.

4. A container in accordance with claim 1 wherein said first attachment panel is attached integrally to said first wall panel.

5. A container in accordance with claim 1 wherein said first attachment panel is attached integrally to said first wall panel and said second attachment panel is attached integrally to said second wall panel.

6. A container in accordance with claim 4 wherein said second attachment panel is attached adhesively to said first wall panel.

7. A container in accordance with claim 5 wherein a width of said first panel section is different than a width of said second panel section such that said second end of said first panel section and said second end of said second panel section are offset from said first corner when said container is in the knockdown form.

8. A container in accordance with claim 7 wherein said corner support is substantially rectangular in shape.

9. A container in accordance with claim 5 wherein a length of said offset is no less than about 3/16 of an inch.

10. A container in accordance with claim 1 wherein said corner support further comprises an intermediate panel positioned between said upper and lower edges of said corner support, said intermediate panel having a height less than a height of said corner edge and positioned to break the continuity of said corner edge between said top and bottom edges of said corner support.

11. A container in accordance with claim 10 wherein said intermediate panel is arcuate in shape and symmetrical about said corner edge.

12. A container in accordance with claim 10 wherein said intermediate panel has an upper end and a lower end, said corner edge having a first edge section extending between said upper end of said intermediate panel and said upper edge of said corner support and a second edge section extending between said lower end of said intermediate panel and said lower edge of said corner support.

13. A container in accordance with claim 10 wherein said intermediate panel is formed by a fold line scored on an inner face of said corner support, said inner face of said corner support facing said first corner.

14. A container in accordance with claim 10 wherein said intermediate panel is substantially planar.

15. A container in accordance with claim 10 wherein said intermediate panel is elliptical in shape.

16. A container in accordance with claim 5 wherein the width of one of said first and second panel sections at least about 1.5 times the width of the other of said first and second panel sections.

17. A container in accordance with claim 1 wherein said first and second panel sections are attached integrally to one another.

18. A container comprising:

multiple wall panels attached to one another to form the container sides, said wall panels including a first wall panel and a second wall panel attached to one another at a first corner, said first and second wall panels each having an inner face and a top end;

a first attachment panel attached to said first wall panel;

a second attachment panel attached to said second wall panel;

a corner support having upper and lower edges, a corner edge spaced from said first and second wall panels, and first and second panel sections, said corner support being adjacent said inner face of said first and second wall panels;

said first panel section having a first end attached pivotally to said first attachment panel and a second end opposite said first end;

said second panel section having a first end attached pivotally to said second attachment panel and a second end opposite said first end, said second end of said first panel section and said second end of said second panel section being attached pivotally to each other at a corner edge spaced from said first corner; and said container capable of being assembled from a knockdown form wherein said first and second wall panels lie in a substantially same first plane, said first and second panel sections lie in a substantially same second plane adjacent to said first plane, and wherein said corner edge moves to a position spaced from said first and second wall panels when said knockdown is assembled into the container.

19. A container in accordance with claim 18 wherein said corner edge is offset from said first corner when the container is in the knockdown form.

20. A container in accordance with claim 18 wherein said corner support further comprises an intermediate panel positioned between said upper and lower edges of said corner support, said intermediate panel having a height less than a height of said corner edge and positioned to break the continuity of said corner edge between said upper and lower edges of said corner support; and wherein said first, second, and intermediate panel sections lie in said substantially same second plane adjacent to said first plane when said container is in the knockdown form, and wherein said corner edge and intermediate panel move to a position spaced from said first and second wall panels when said knockdown is assembled into the container.

21. A container in accordance with claim 20 wherein said intermediate panel has an upper end and a lower end, said corner edge having a first edge section extending between said upper end of said intermediate panel and said upper edge of said corner support and a second edge section extending between said lower end of said intermediate panel and said lower edge of said corner support.

22. A container in accordance with claim 21 wherein said intermediate panel is arcuate in shape and symmetrical about said corner edge.

23. A container in accordance with claim 20 wherein said intermediate panel is formed by a fold line scored on an inner face of said corner support, said inner face of said corner support facing said first corner.

* * * * *

UNITED STATES PATENT AND TRADEMARK OFFICE

CERTIFICATE OF CORRECTION

PATENT NO. : 6,817,514 B2
DATED : November 16, 2004
INVENTOR(S) : Kanter et al.

Figure 11:
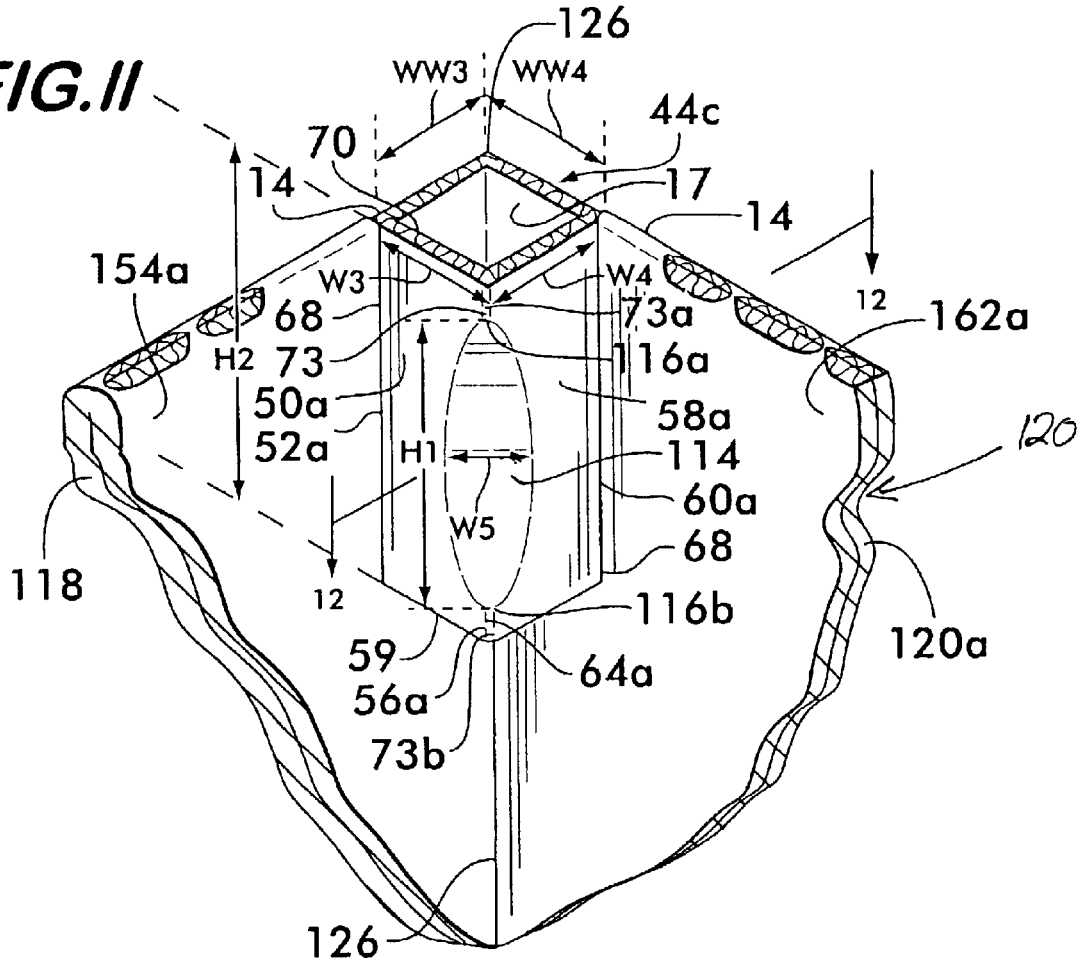
FIG. 11 is an enlarged view of the support corner of FIG. 10.

It is certified that error appears in the above-identified patent and that said Letters Patent is hereby corrected as shown below:

Column 8,
Line 33, should read -- With reference to FIGS. 10, 11, and 12, a container 110 having rectangular corner supports 44*c* with an intermediate panel is now described. --.

Signed and Sealed this

Sixth Day of September, 2005

JON W. DUDAS
*Director of the United States Patent and Trademark Office*